US010495318B2

(12) United States Patent
Greenbaum et al.

(10) Patent No.: US 10,495,318 B2
(45) Date of Patent: Dec. 3, 2019

(54) BALANCED COOLING DUCT FOR COOKING OVEN

(71) Applicant: Electrolux Home Products, Inc., Charlotte, NC (US)

(72) Inventors: Mark Greenbaum, Brentwood, TN (US); James Leavy, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 215 days.

(21) Appl. No.: 15/606,002

(22) Filed: May 26, 2017

(65) Prior Publication Data

US 2018/0340694 A1 Nov. 29, 2018

(51) Int. Cl.
*F24C 15/00* (2006.01)

(52) U.S. Cl.
CPC ..... *F24C 15/006* (2013.01)

(58) Field of Classification Search
CPC ..... F24C 15/02; F24C 13/004; F24C 15/10; A47J 37/0623
See application file for complete search history.

(56) References Cited

U.S. PATENT DOCUMENTS

| | | | | |
|---|---|---|---|---|
| 3,633,561 | A * | 1/1972 | Barnett | F24C 14/02 126/21 R |
| 4,108,139 | A | 8/1978 | Gilliom et al. | |
| 4,327,274 | A | 4/1982 | White et al. | |
| 4,354,084 | A | 10/1982 | Husslein et al. | |
| 4,865,010 | A | 9/1989 | Kett | |
| 5,107,821 | A | 4/1992 | Blanquet | |
| 6,689,991 | B2 | 2/2004 | Kim et al. | |
| 7,721,728 | B2 * | 5/2010 | Ho Kim | F24C 15/006 126/198 |
| 8,039,775 | B2 | 10/2011 | Venezia | |
| 8,141,549 | B2 | 3/2012 | Armstrong et al. | |
| 8,707,945 | B2 | 4/2014 | Hasslberger | |
| 9,191,999 | B2 | 11/2015 | Anthony et al. | |
| 9,513,015 | B2 * | 12/2016 | Estrella | F24C 15/006 |
| 2015/0369491 | A1 | 12/2015 | Estrella et al. | |
| 2016/0348918 | A1 * | 12/2016 | Bhogal | F24C 15/04 |

FOREIGN PATENT DOCUMENTS

| | | |
|---|---|---|
| CH | 583886 | 1/1977 |
| DE | 19957721 | 5/2001 |
| DE | 10341076 | 3/2005 |
| DE | 102004003409 | 8/2005 |
| DE | 202009009065 | 12/2010 |
| EP | 1731843 | 12/2006 |
| GB | 238186 | 10/1925 |

OTHER PUBLICATIONS

International Search Report and Written Opinion for PCT/US2018/031471, dated Sep. 21, 2018, 19 pages.

* cited by examiner

*Primary Examiner* — Gregory A Wilson
(74) *Attorney, Agent, or Firm* — Pearne & Gordon LLP

(57) ABSTRACT

The present disclosure relates to a cooking oven having a cooling duct and a cooling fan that is laterally offset relative to a center of the inlet of the cooling duct. The cooling duct has two lateral cooling duct walls extended between the cooling duct inlet and a cooling duct outlet. The cooling duct is designed such that when the cooling fan is operated air flowing along the respective lateral walls will experience substantially equal pressure drop between the inlet and the fan.

15 Claims, 4 Drawing Sheets

BALANCED COOLING DUCT FOR COOKING OVEN

BACKGROUND

Cooling ducts are used in conjunction with cooking cavities in cooking ovens to protect temperature-sensitive components (such as electronic controllers, input interfaces and related circuitry) from the cooking cavity. Cooling is also provided to protect the cabinetry from high temperatures that could cause fires. A cooling duct is connected to a cooling fan to draw air through the cooling duct to provide a protecting layer of flowing air. The cooling duct can have an inlet adjacent an outer face, e.g. at the front face or lower rear face, of the cooking oven to draw cool air from the environment in order to protect sensitive circuitry, such as control panels, disposed at the front face of the appliance. The inlet can run substantially the full width of the outer face, e.g. the front face, of the cooking oven so that air can be drawn across substantially the full width. This can be desirable, for example, in case such control panel or other circuitry at the front face of the appliance spans its full width. The exhaust of the cooling fan can be directed upward to the rear of the oven, or in separate ducts forward above the cavity door.

In order for the cooling duct to uniformly thermally isolate the cooking cavity from superjacent structure adjacent the front face of the cooking oven, the air flow through the inlet of the cooling duct should be substantially uniform adjacent either side. With an intake fan centrally placed this is readily achievable. But in some situations, it is advantageous for the cooling fan to be laterally offset at the rear of the appliance; for example so the cooling fan does not interfere with other, more centrally-located structures of the cooking oven. It would be desirable to maintain substantially uniform air flow across the inlet of the cooling duct in this case, and particularly adjacent either side of the inlet.

SUMMARY

A cooking oven that includes a cooling duct and a cooling fan is disclosed. The cooling duct includes (i) a cooling duct inlet along an outer face of the cooking oven, (ii) a cooling duct outlet in fluid communication with the cooling fan, (iii) a first lateral cooling duct wall and a second lateral cooling duct wall, each lateral cooling duct wall extending between the cooling duct inlet and the cooling duct outlet, (iv) a first air-flow path running from the cooling duct inlet to the cooling duct outlet adjacent the first lateral cooling duct wall, and (v) a second air-flow path running from the cooling duct inlet to the cooling duct outlet adjacent the second lateral cooling duct wall. The cooling fan is laterally offset relative to a center of the cooling duct inlet. The pressure drop along the first air-flow path is substantially equal to the pressure drop along the second air-flow path.

Another embodiment of a cooking oven also includes a cooling duct and a cooling fan. The cooling duct includes (i) a cooling duct inlet along an outer face of the cooking oven, (ii) a cooling duct outlet in fluid communication with the cooling fan, (iii) a first lateral cooling duct wall and a second lateral cooling duct wall, each lateral cooling duct wall extending between the cooling duct inlet and the cooling duct outlet, and (iv) a flow-restricting element adjacent the first lateral cooling duct wall to introduce a local pressure drop along a first air-flow path adjacent that wall. The cooling fan is laterally offset relative to a center of the cooling duct inlet.

A method of operating a cooking oven also is provided. The method includes drawing a flow of cooling air through a cooling duct via a cooling duct inlet that spans substantially the full width of an outer face of the oven between first and second cooling duct inlet ends, to a cooling fan that is laterally offset relative to a center of the cooling duct inlet. A first portion of the cooling air follows a first air-flow path extending from the first cooling duct inlet end adjacent a first lateral cooling duct wall, and a second portion of the cooling air follows a second air-flow path extending from the second cooling duct inlet end adjacent a second lateral cooling duct wall. The first and second portions of the cooling air experience substantially the same pressure drop along the respective first and second air-flow paths between the cooling duct inlet and the cooling fan.

DETAIL DESCRIPTION OF PREFERRED EMBODIMENTS

Figure 1:
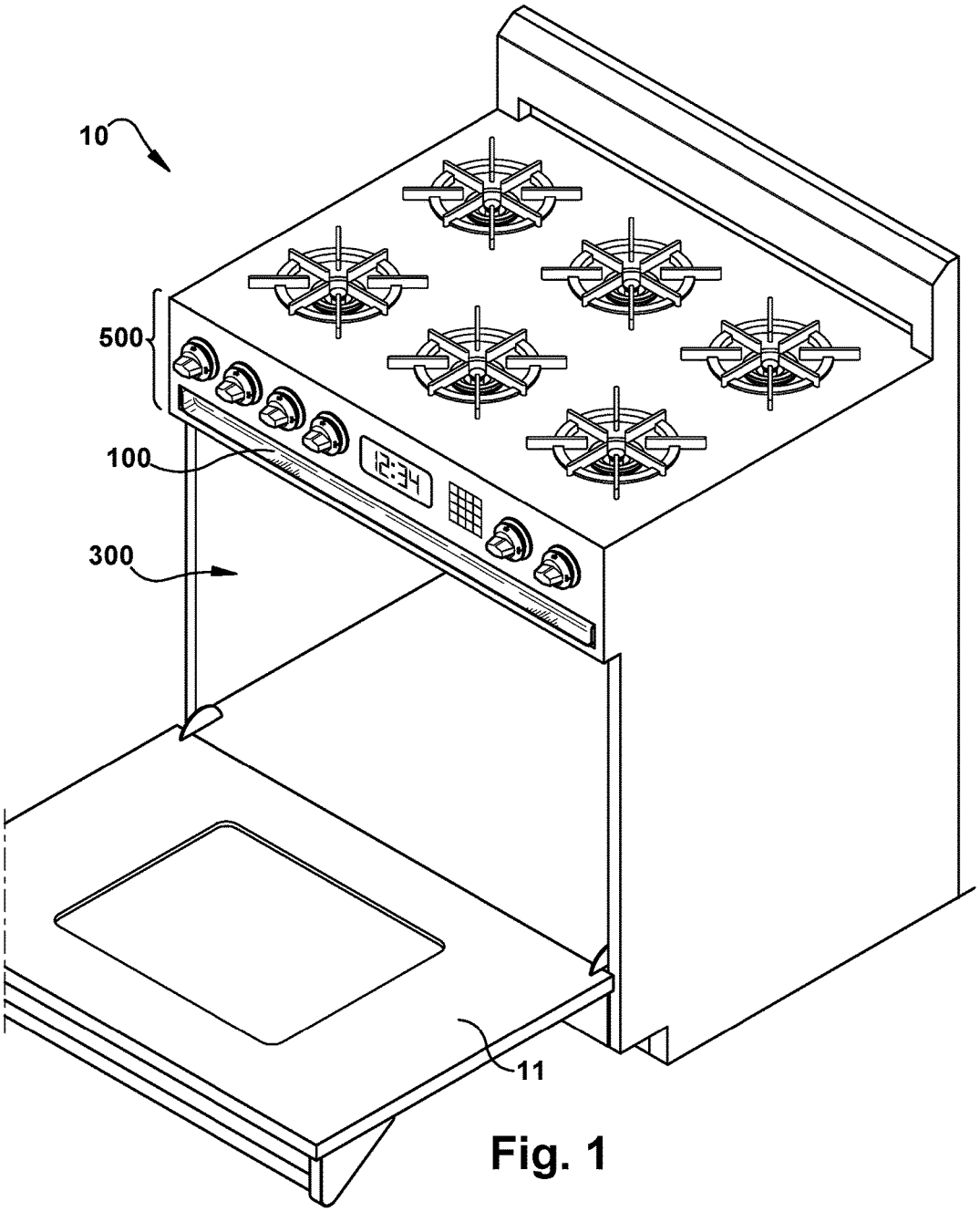
FIG. 1 shows a front perspective view of one embodiment of a cooking oven having a cooling duct to protect a front control panel from heat escaping from the oven cavity.
Figure 2:
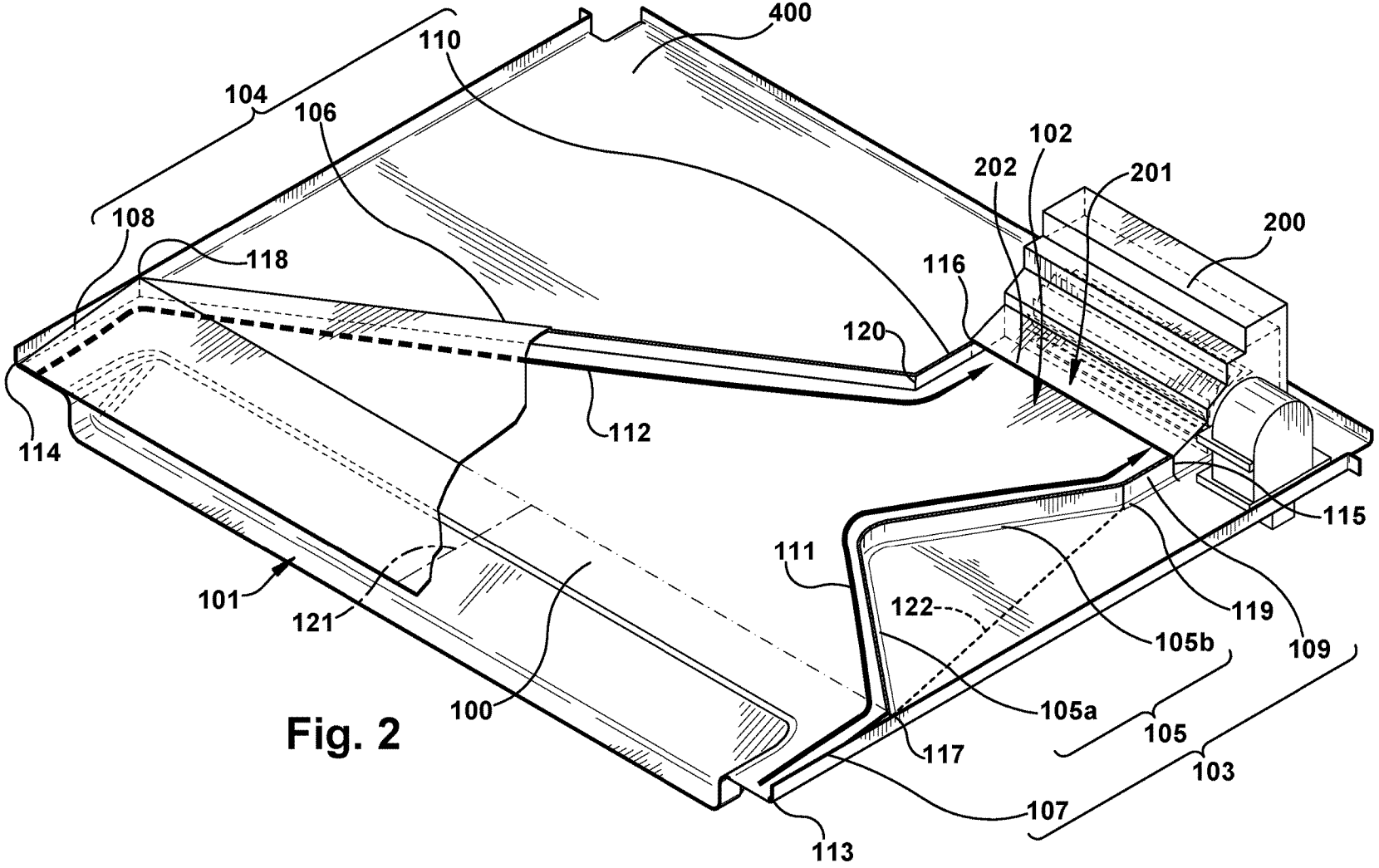
FIG. 2 shows a top perspective view of a first embodiment of a balanced cooling duct disposed above an oven cavity in a cooking oven, with portions of the appliance removed to reveal the cooling duct.

FIGS. 1 and 2 depict a first embodiment of a cooking oven 10 having a balanced cooling duct 100. As seen in FIG. 2, the cooling duct 100 is connected at its rear to a cooling fan 200 in order to draw cooling air through the duct 100 via duct inlet 101, in order to provide a protecting layer of cool air to protect sensitive components against heat from the cooking cavity 300. In the illustrated embodiment the cooling duct inlet 101 extends along a front face of the cooking oven 10. Alternatively, the inlet can be disposed at or adjacent other faces of the oven; however the remainder of the description is given with respect to the embodiment illustrated in FIGS. 1 and 2. FIG. 1 illustrates the cooking oven 10 with the oven door 11 open to better visualize the cooking cavity 300 and other elements here described. Above the cooking cavity 300 is the cooling duct 100 having a cooling duct inlet 101 visibly extending across the front face of the oven 10 and separating the cavity 300 from electrical components in and behind the control panel 500. As will be described, in operation cooling air is drawn into the cooling duct 100 via inlet 101. In embodiments, the cooking oven 10 can be configured so that air entering the inlet 101 is drawn from an air exit of a vertically extending channel in the oven door 11 as known in the art, when the door 11 is in the closed position. In this manner the flow of air both maintains a safe external door surface temperature and serves to thermally isolate the cooking cavity 300 from other components as further described.

A cooling duct outlet 102 is in fluid communication with the cooling fan 200 adjacent the rear of the cooking oven 10. The duct 100 has a first lateral cooling duct wall 103 and a second lateral cooling duct wall 104, each extending between the cooling duct inlet 101 and the cooling duct outlet 102. The first lateral cooling duct wall 103 extends between a first cooling duct inlet end 113 and a first cooling duct outlet end 115 at one side of the duct 100, whereas the second lateral cooling duct wall 104 extends between a second cooling duct inlet end 114 and a second cooling duct outlet end 116 at the opposite side of the duct 100.

As depicted in FIG. 2, the first lateral cooling duct wall 103 has three sections: a first inlet section 107 adjacent the inlet 101 of the duct 100, a first outlet section 109 adjacent the outlet 102, and a first intermediate section 105 between the respective inlet and outlet sections 107 and 109. The first inlet section 107 extends from the first cooling duct inlet end 113 and meets the first intermediate section 105 at first inlet joint 117. The first outlet section 109 extends from the first cooling duct outlet end 115 and meets the first intermediate section 105 at first outlet joint 119. The second lateral cooling duct wall 104 also has three sections: second intermediate section 106, second inlet section 108, and second outlet section 110. The second inlet section 108 extends from the second cooling duct inlet end 114 and meets the second intermediate section 106 at second inlet joint 118. The second outlet section 110 extends from the second cooling duct outlet end 116 and meets the second intermediate section 106 at second outlet joint 120. As shown, the respective lengths of first inlet section 107 and the second inlet section 108 are substantially equal. Similarly, the respective lengths of first outlet section 109 and the second outlet section 110 are substantially equal.

The cooling fan 200 has a cooling fan inlet 201 that is connected to the cooling duct outlet 102 via a connection 202. The cooling fan 200 is laterally offset relative to the center 121 of the cooling duct inlet 101, which may be necessary or desirable to accommodate additional structure resident at the rear of the appliance. To generate movement of air within the duct 100, the cooling fan 200 creates a pressure drop that draws air into the cooling duct 100 via cooling duct inlet 101 at the front face of the oven 10, though the duct 100 and out the cooling duct outlet 102.

Within the cooling duct 100, a first air-flow path 111 adjacent the first lateral cooling duct wall 103 runs from the cooling duct inlet 101 along the first inlet section 107, the first intermediate section 105, and the first outlet section 109 to the cooling duct outlet 102. A second air-flow path 112 adjacent the second lateral cooling duct wall 104 runs from the cooling duct inlet 101 along the second inlet section 108, the second intermediate section 106, and the second outlet section 110 to the cooling duct outlet 102.

When the fan 200 is laterally offset as seen in FIG. 2, one of the air-flow paths 111 and 112 ordinarily would be shorter than the other were they both direct; i.e. following the shortest path between inlet 101 and outlet 102. This can be seen, for example, comparing the length of the second intermediate section 106 adjacent one side of the appliance, to the imaginary dashed line 122 in the figure, which approximates the straight-line path that first intermediate section 105 would take between the first inlet section 107 and the first outlet section 109 were it configured to provide the shortest distance. When both the inlet sections 107 and 108 are equal and both the outlet sections 109 and 110 are equal as shown, the relative difference in total path length, and therefore pressure drop, between the two air-flow paths 111 and 112 would be dictated by the disparate lengths or other features between the first and second intermediate sections 105 and 106. For example, were the first intermediate section 105 configured to provide the straight-line path of dashed line 122, such construction would result in flow through the duct being concentrated adjacent the first lateral duct wall 103 because the pressure drop along that wall 103 would be lower than along the opposite lateral wall 104. This would result in uneven cooling air flow, which would diminish cooling performance of the duct 100 adjacent the second lateral wall 104.

In order to balance the cooling duct 100 such that air will flow into the inlet 101 substantially uniformly adjacent both the first and second inlet ends 113 and 114 and the associated air-flow paths 111 and 112, it is desirable that the pressure drop along the first air-flow path 111 and the second air-flow path 112 are made substantially equal. One way to do that is to ensure that the path lengths of the respective flow paths are substantially equal. Another way is to introduce an additional pressure drop in the flow path (either path 111 or 112) that otherwise would present a more direct path than the other between the inlet 101 and outlet 102. Either or both of these features can help ensure that the pressure drop along both flow paths 111 and 112 is made substantially equal, which will result in substantially uniform air flow adjacent both lateral walls 103 and 104, and preferably across the full width of the inlet 101.

Such features are shown in FIG. 2. That is, the first intermediate section 103 is formed as a protrusion that extends laterally into the duct volume, which results in an apex or peak that air flowing along air-flow path 111 must negotiate between the first inlet end 113 and the first outlet end 115. This abrupt change in direction constitutes a feature that introduces a pressure drop into that flow path 111. At the same time, that apex is formed from a first protrusion section 105*a* extending in a first direction and a second protrusion section 105*b* extending in a second direction, which together elongate the first air-flow path 111 to approximate that of the second air-flow path 112.

In this embodiment, the combined length of the first protrusion section 105*a* and the second protrusion section 105*b* result in the first intermediate section 103 having substantially the same length as the second intermediate section 104. Because the respective lengths of first inlet section 107 and the second inlet section 108 are substantially equal and the respective lengths of first outlet section 109 and the second outlet section 110 are substantially equal, this results in the first air-flow path 111 and the second air-flow path 112 having substantially equal lengths.

As a result of these features, the first air-flow path 111 and the second air-flow path 112 can have substantially equal pressure drops between the inlet 101 and the outlet 102 such that air flow along those two paths is substantially uniform when drawn from the same fan 200.

In alternative embodiments, the relative distances along the different sections of the lateral cooling duct walls, such as inlet sections 107/108, intermediate sections 105/106, and outlet sections 109/110, can be variable as long as the total pressure drop for the first air-flow path 111 adjacent the first lateral cooling duct wall 103 is substantially equal to the total pressure drop for the second air-flow path 112 adjacent the second lateral cooling duct wall 104. For example, the first outlet section 109 can be longer than the second outlet section 110, which tends to lengthen the first air-flow path 111. In this case, it may be desirable that the first intermediate section 105 be made shorter to maintain the overall length of the first air-flow path 111 so that it is substantially equal to the second air-flow path 112. Still other sections of the respective lateral walls 103 and 104 can be made relatively longer or shorter, while adhering to the principle that the overall pressure drops adjacent the respective first and second flow paths 111 and 112 adjacent those walls 103 and 104 be maintained substantially equal. This can be achieved by adjusting the overall lengths and paths of the walls 103 and 104 are substantially constant, as well as by introducing alternative pressure-drop features along one or both of the walls 103 and 104.

Figure 3:
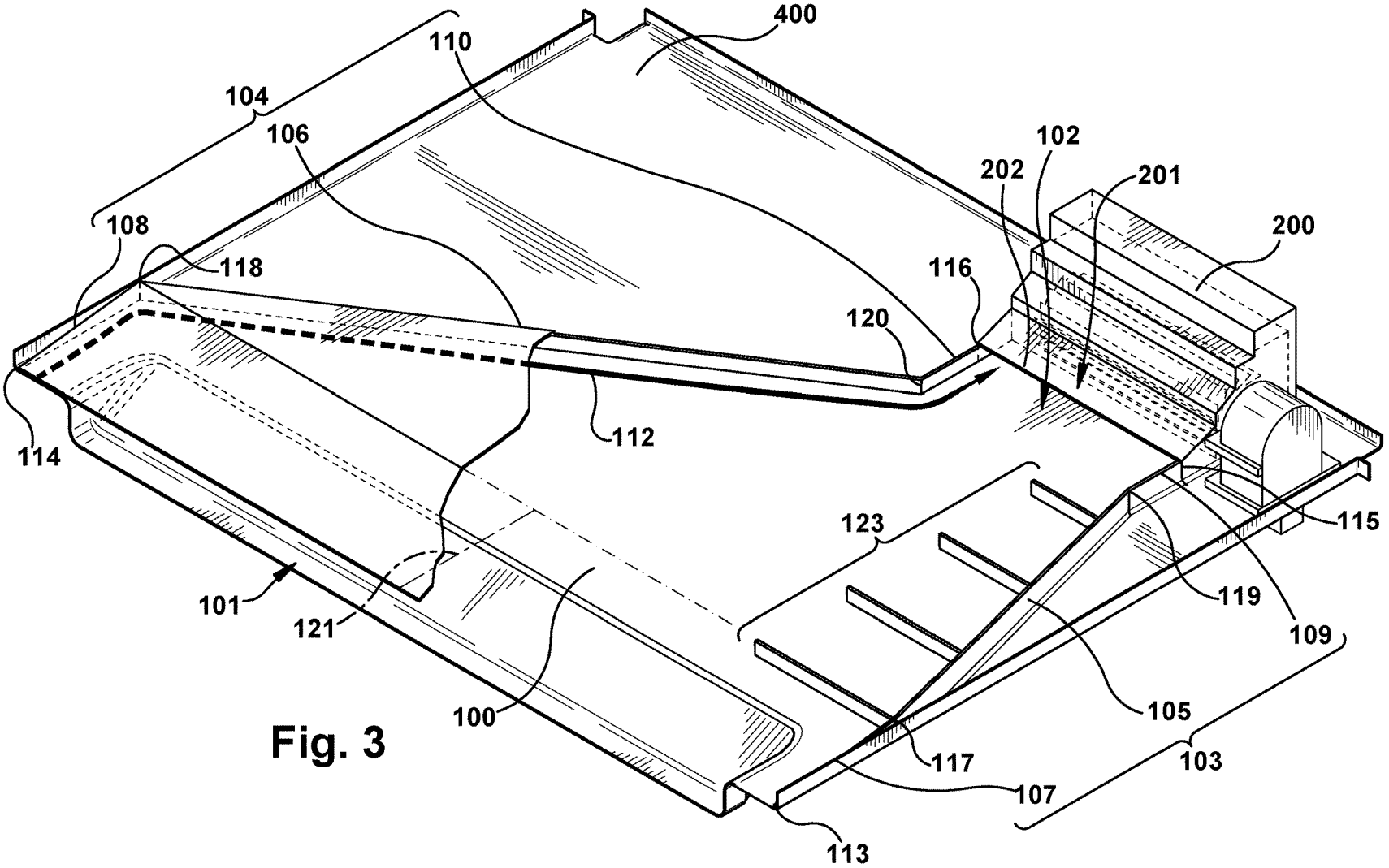
FIG. 3 shows a top perspective view of a second embodiment of a balanced cooling duct.
Figure 4:
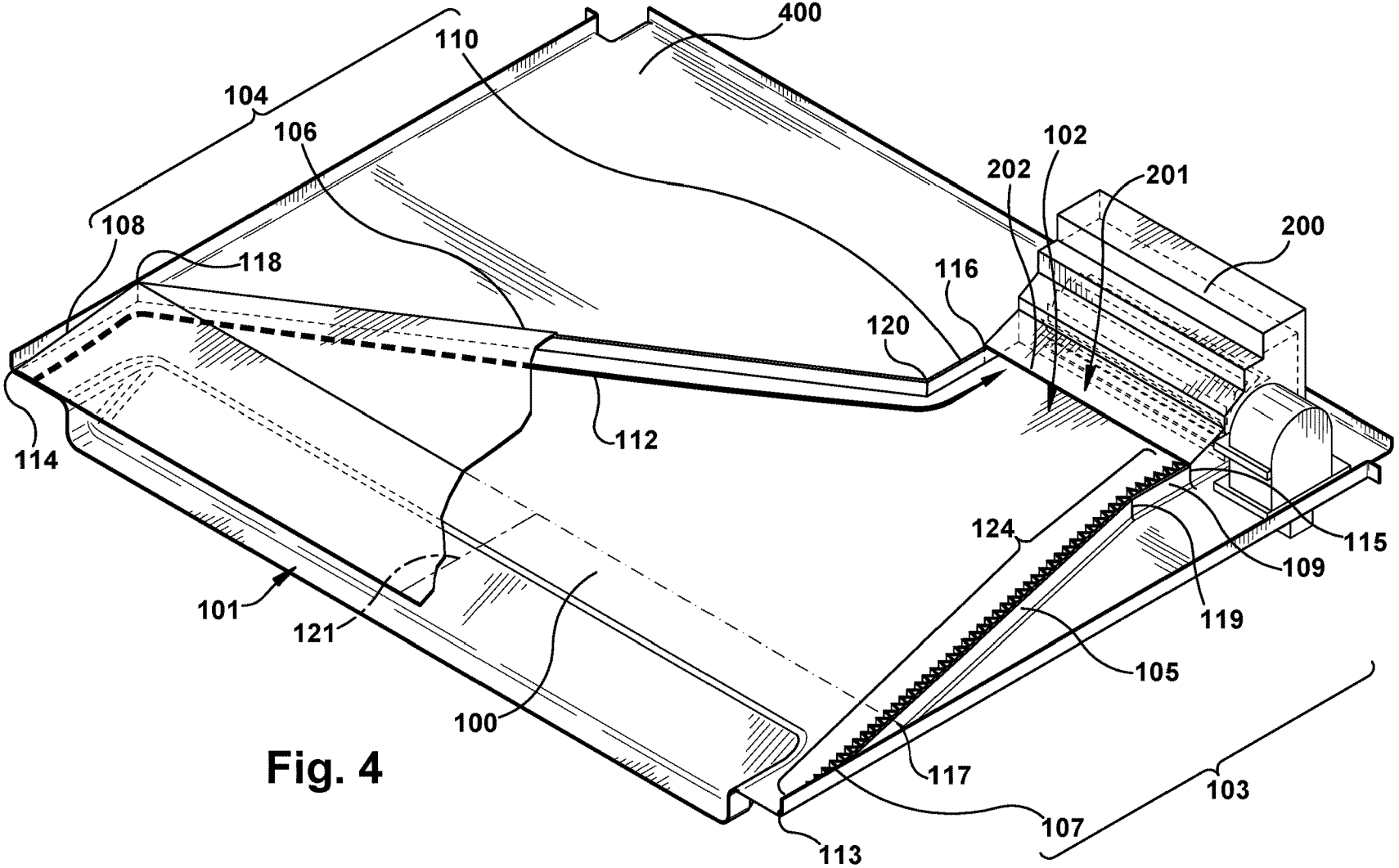
FIG. 4 shows a top perspective view of a third embodiment of a balanced cooling duct.

Another example of a balanced cooling duct 100 is one having unequal, linear lateral walls 103 and 104, but with a flow-restricting element to introduce an additional pressure drop along the shorter of those two walls to equalize the pressure drop between the respective first and second air-flow paths 111 and 112. Examples of such flow-restricting elements include a roughened wall section having a rough surface that will introduce additional friction and thus resistance to flow, one or more baffles extending from the wall adjacent the flow path, a filter (such as a screen or perforated baffle or sheet), for example covering the inlet adjacent one of the inlet ends, vanes that will redirect air flow along arcuate (e.g. helical) paths and thus introduce pressure drop, an impeller or fan acting in a flow direction opposite that of the superficial mass flow adjacent one of the walls 103 and 104, as well as combinations thereof. FIG. 3 shows an example cooling duct 100 having a series of baffles 123 extending from the first lateral cooling duct wall 103 at spaced intervals. FIG. 4 shows another example cooling duct 100 having a roughed wall section 124 along the first lateral cooling duct wall 103. Other flow-restricting elements are well known and could be selected by ones having ordinary skill in the art.

The cooling duct 100 has been described above as having lateral walls 103 and 104 having respective and distinct inlet sections 107/108, outlet sections 109/110 and intermediate sections 105 and 106. Indeed, the principles described above can be practiced in a cooling duct whose lateral walls 103 and 104 have fewer than the three distinct sections noted above; for example only two distinct sections or even just one continuous wall without discrete inflections between the respective inlet end 113/114 and outlet end.

In still additional alternative embodiments, the inlet joints 117/118 and/or the outlet joints 119/120 can be curved sections rather sharp bends. Thus, if the inlet joints 117/118 are curved, the inlet sections 107/108 can gradually transition into the lateral cooling duct walls 103/104, or be indistinct from them. Additionally, if the outlet joints 119/120 are curved, the lateral cooling duct walls 103/104 can gradually transition into the outlet sections 109/110, or again be indistinct from them.

Optionally, a metal insulation shield 400 can be positioned adjacent (preferably beneath) the cooling duct 100 to better isolate the cooking cavity from temperature-sensitive components on the opposite side of the shield 400. The metal insulation shield 400 can be made of a material with high specific heat capacity such that it can absorb heat energy from the cooking cavity without rapidly increasing the temperature of the insulation shield. In this way, heat energy from the cooking cavity can be absorbed by the shield 400 and dissipated (e.g. via heat exchange with the cooling air flow through the duct 100) so that it does not reach the temperature-sensitive components of the oven. The metal insulation shield 400 can be disposed between the cooling duct 100 and the cooking cavity 300.

What is claimed is:

1. A cooking oven comprising:

a cooling duct and a cooling fan;

the cooling duct comprising a cooling duct inlet adjacent an outer face of the cooking oven, a cooling duct outlet in fluid communication with the cooling fan, a first lateral cooling duct wall and a second lateral cooling duct wall, each lateral cooling duct wall extending between the cooling duct inlet and the cooling duct outlet, a first air-flow path running from the cooling duct inlet to the cooling duct outlet adjacent the first lateral cooling duct wall, and a second air-flow path running from the cooling duct inlet to the cooling duct outlet adjacent the second lateral cooling duct wall;

the cooling fan being laterally offset relative to a center of the cooling duct inlet;

wherein the pressure drop along the first air-flow path is substantially equal to the pressure drop along the second air-flow path.

2. The cooking oven of claim 1, the length of the first lateral cooling duct wall being substantially equal to the length of the second lateral cooling duct wall.

3. The cooking oven of claim 1, the first lateral cooling duct wall comprising a protrusion.

4. The cooking oven of claim 1, further comprising a cooking cavity and a metal insulation shield between the cooking cavity and the cooling duct.

5. The cooking oven of claim 1, said first air-flow path being shorter than said second air-flow path, at least one flow-restricting element being disposed in said first air-flow path to substantially equalize the pressure drop between the first and second air-flow paths.

6. A cooking oven comprising:

a cooling duct and a cooling fan, the cooling fan being laterally offset relative to a center of a cooling duct inlet;

the cooling duct comprising said cooling duct inlet adjacent an outer face of the cooking oven, a cooling duct outlet in fluid communication with the cooling fan, a first lateral cooling duct wall and a second lateral cooling duct wall, each lateral cooling duct wall extending between the cooling duct inlet and the cooling duct outlet; and a flow-restricting element adjacent said first lateral cooling duct wall to introduce a local pressure drop along a first air-flow path adjacent that wall.

7. The cooking oven of claim 6, the flow-restricting element comprising a protrusion in said first lateral cooling duct wall, a rough surface on the first lateral cooling duct wall; or one or more baffles.

8. The cooking oven of claim 6, further comprising a cooking cavity and a metal insulation shield between the cooking cavity and the cooling duct.

9. The cooking oven of claim 6, further comprising a second air-flow path adjacent said second lateral cooling duct wall, wherein the total pressure drop along the first air-flow path is substantially equal to the total pressure drop along the second air-flow path.

10. A method of operating a cooking oven comprising:

drawing a flow of cooling air through a cooling duct via a cooling duct inlet that spans substantially a full width of an outer face of said oven between first and second cooling duct inlet ends, to a cooling fan that is laterally offset relative to a center of said cooling duct inlet, wherein a first portion of said cooling air follows a first air-flow path extending from said first cooling duct inlet end adjacent a first lateral cooling duct wall and a second portion of said cooling air follows a second air-flow path extending from said second cooling duct inlet end adjacent a second lateral cooling duct wall, and wherein said first and second portions of said cooling air experience substantially the same pressure drop along the respective first and second air-flow paths between said cooling duct inlet and said cooling fan.

11. The method of claim 10, wherein the length of the first lateral cooling duct wall is substantially equal to the length of the second lateral cooling duct wall.

12. The method of claim 11, the first lateral cooling duct wall comprising a protrusion.

13. The method of claim 10, the cooling duct further comprising a flow-restricting element to introduce an additional local pressure drop along the first air-flow path.

14. The method of claim 13, the flow-restricting element comprising a protrusion in said first lateral cooling duct wall; a rough surface on the first lateral cooling duct wall; or one or more baffles.

15. The method of claim 10, the cooking oven further comprising a cooking cavity and a metal insulation shield between the cooking cavity and the cooling duct, said shield being effective to absorb thermal energy from said cooking cavity and to dissipate said thermal energy via heat-exchange with said cooling air flowing through said cooling duct.

* * * * *